US008749153B2

(12) United States Patent
Xie et al.

(10) Patent No.: US 8,749,153 B2
(45) Date of Patent: Jun. 10, 2014

(54) LED DRIVING CIRCUIT

(75) Inventors: Ling-Yu Xie, Shenzhen (CN); Xing-Ping Xie, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 400 days.

(21) Appl. No.: 13/188,212

(22) Filed: Jul. 21, 2011

(65) Prior Publication Data

US 2012/0169252 A1 Jul. 5, 2012

(30) Foreign Application Priority Data

Dec. 29, 2010 (CN) ..... 20101061137638

(51) Int. Cl.
*H05B 37/02* (2006.01)

(52) U.S. Cl.
USPC ..... 315/209 R; 315/291

(58) Field of Classification Search
USPC ..... 315/209 R, 247, 291
See application file for complete search history.

(56) References Cited

U.S. PATENT DOCUMENTS

| | | | | |
|---|---|---|---|---|
| 7,977,890 | B2 * | 7/2011 | Kumagai | 315/247 |
| 8,324,825 | B2 * | 12/2012 | Shao et al. | 315/291 |
| 2011/0140630 | A1 * | 6/2011 | Doudousakis et al. | 315/291 |

* cited by examiner

*Primary Examiner* — Thuy Vinh Tran
(74) *Attorney, Agent, or Firm* — Novak Druce Connolly Bove + Quigg LLP

(57) ABSTRACT

A Light Emitting Diode (LED) driving circuit includes a power supply circuit, an LED circuit, and a switch control circuit. The power supply circuit includes an energy storage device and a switch component connected to the energy storage device. The energy storage device stores electric power when the switch component is switched on. The LED circuit is connected to the energy storage device. The switch control circuit is connected to the switch component, and is adapted to control the on/off states of the switch component, thereby adjusting a current flowing through the LED circuit.

10 Claims, 2 Drawing Sheets

LED DRIVING CIRCUIT

BACKGROUND

1. Technical Field

The present disclosure relates to a Light Emitting Diode (LED) driving circuit capable of adjusting a current flowing through LEDS.

2. Description of Related Art

A typical LED driving circuit includes a bridge rectifier circuit, a filter circuit, a buck converter (output voltage less than input voltage). The bridge rectifier circuit can convert alternating current voltage to direct current (DC) voltage. The buck converter outputs a low voltage to the LEDS. Then the LEDS are lit. However, the voltage and current supplied to the LEDS is not adjustable, and sometimes less or more than the normal range. The LEDS can be easily damaged in the case of over current or undercurrent.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation. In the figures of the accompanying drawings in which like references indicate similar elements. It should be noted that references to "an" or "one" embodiment in this disclosure are not necessarily to the same embodiment, and such references mean at least one.

Figure 1:
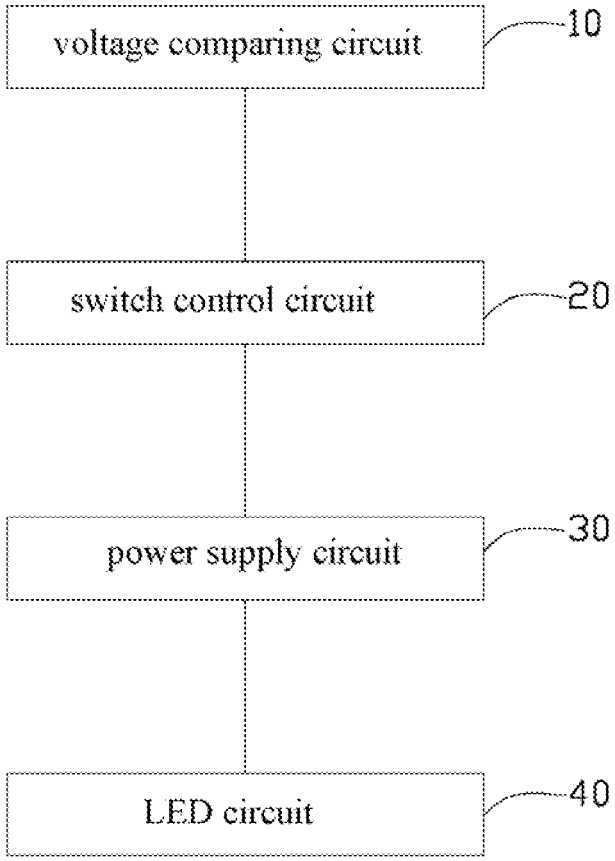
FIG. 1 is a block diagram of a LED driving circuit according to an embodiment.
Figure 2:
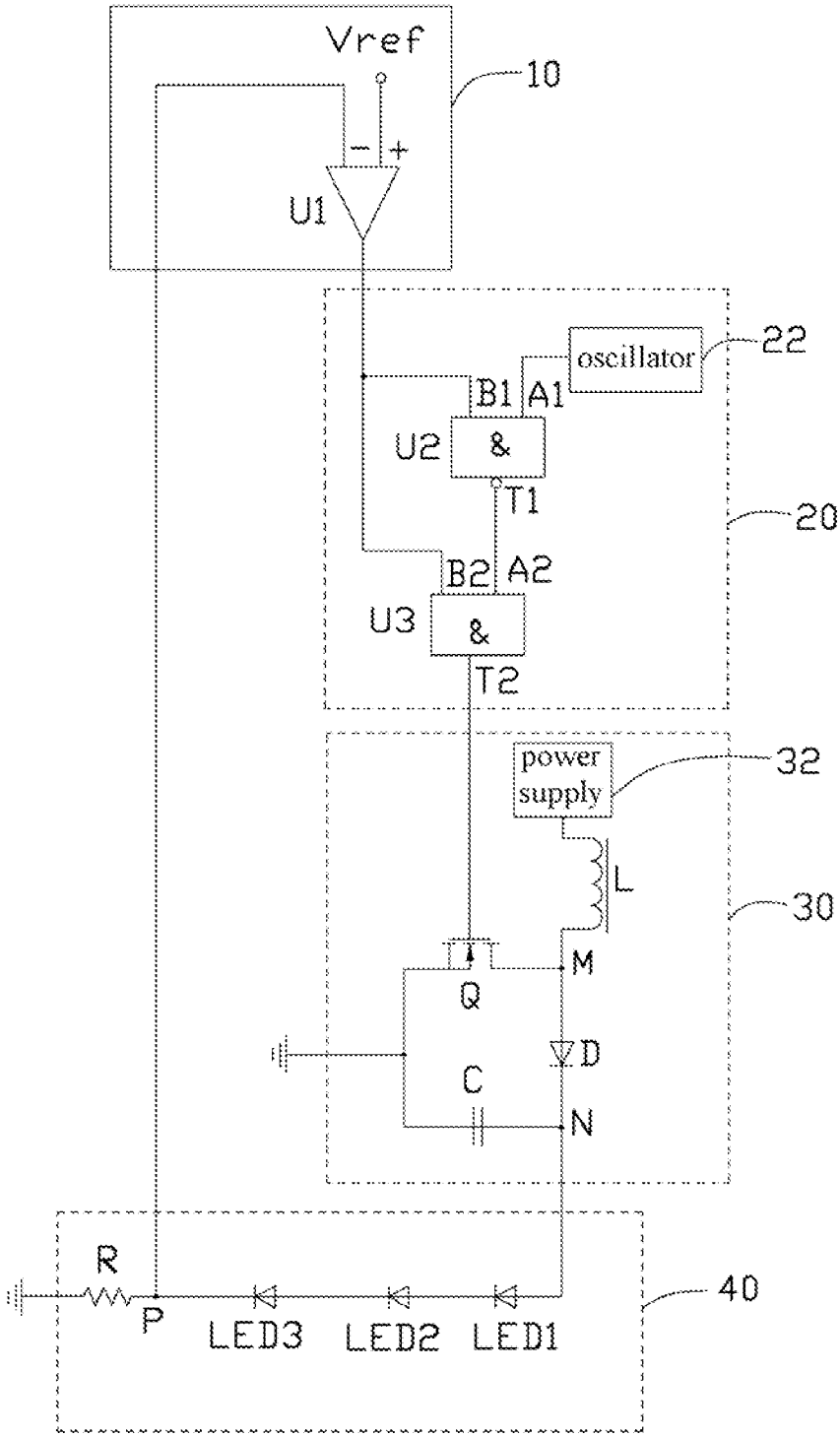
FIG. 2 is a detailed circuit of the LED driving circuit of FIG. 1, showing a rechargeable battery connected to a DC power source in a first manner.

Referring to FIGS. 1 and 2, an embodiment of an LED driving circuit includes a voltage comparing circuit 10, a switch control circuit 20, a power supply circuit 30, and an indicating circuit 40.

The voltage comparing circuit 10 includes a comparator U1. The comparator U1 includes a positive input terminal connected to a reference voltage Vref, a negative input terminal connected to a first node P, and an output terminal connected to the switch control circuit 20.

The switch control circuit 20 includes an oscillator 22, a NAND gate U2, and an AND gate U3. The NAND gate U2 includes a first input terminal A1 connected to the oscillator 22, a second input terminal B1 connected to the comparator 10 output terminal, and a first output terminal T1. The AND gate U3 includes a third input terminal A2 connected to the first output terminal T1, a fourth input terminal B2 connected to the comparator 10 output terminal, and a second output terminal T2 connected to the power supply circuit 30.

The power supply circuit 30 includes a power supply 32, an inductor L, a Field Effect Transistor (FET) Q, a diode D, and a capacitor C. The power supply 32 can provide a direct current (DC) voltage of 5 volts, or 12 volts. A first terminal of the inductor L is connected to the power supply 32. A second terminal of the inductor L is connected to a second node M.

The FET Q is an N-channel enhancement FET. The FET Q includes a gate terminal connected to the second output terminal T2, a drain terminal connected to the second node M, and a source terminal connected to ground. When a voltage at the gate terminal is at a high level (e.g., ≥5V), the FET Q is rendered conductive (switched on). When the voltage at the gate terminal is at a low level (e.g., 0V), the FET Q is rendered non-conductive (switched off). The diode D includes an anode connected to the second node M, and a cathode connected to a third node N. The capacitor C includes a first terminal connected to the third node N, and a second terminal connected to ground.

The LED circuit 40 includes LED1-LED3, which are connected in series, and a resistor R. LED1 includes a first anode connected to the third node N, and a first cathode connected to a second anode of the LED2. A second cathode of the LED2 is connected to a third anode of the LED3. A third cathode of the LED3 is connected to the first node P. The resistor R includes a first terminal connected to the first node P, and a second terminal connected to ground.

When the LED driving circuit starts, the power supply 32 is switched on. A current flowing through the inductor L increases. When the current flowing through the inductor L does not reach a predetermined value, a voltage at the first node P is less than the reference voltage Vref. Thus, the comparator U1 output terminal outputs a high level signal to the second input terminal B1 and the fourth input terminal B2. The oscillator 22 output a square wave signal to the first input terminal A1. Because a square wave signal repeats itself and will go, say, from a low level signal to a high level signal and vice versa, the first output terminal T1 goes from the high level to the low level and vice versa. The second output terminal T2 will follow the first output terminal T1 and go from the high level to the low level and vice versa. That is, a voltage level of each of the NAND gate U2 and the AND gate U3 is opposite to that of the square wave signal. The FET Q is switched on or off with a frequency equal to the frequency of the square wave signal. The inductor L stores electric power when the FET Q is switched on, and discharges the electric power to the capacitor C when the FET Q is switched off. As the electric power of the capacitor C increases gradually, the voltage at the third node N increases correspondingly. A current flowing through the LED circuit 40 increases gradually. When the current flowing through the LED circuit 40 exceeds a predetermined value, the voltage at the first node P exceeds the reference voltage Vref. Thus, the comparator U1 output terminal outputs a low level signal to the second input terminal B1 and the fourth input terminal B2. Because of the characteristics of the NAND gate U2, the first output terminal T1 will be maintained at a high level irrespective of the input at A1. And because of the characteristic of the AND gate U3, the second output terminal T2 will be maintained at a low level. The FET Q is switched off. A current flowing to the inductor L decreases. The current flowing to the LED circuit 40 also decreases. When the current flowing to the LED circuit 40 becomes less than the predetermined value, the voltage at the first node P becomes less than the reference voltage Vref. The comparator U1 output terminal returns to the high level. The second output terminal T2 returns output regular high/low signals to the FET Q. The FET Q returns to be switched on or off periodically.

In one embodiment, the LED driving circuit can automatically decrease the current flowing through the LED circuit 40 when a over-current is detected, and increase the current when a undercurrent is detected. Therefore, the current flowing through each of the LED1-LED3 can be maintained in a normal range.

While the present disclosure has been illustrated by the description of preferred embodiments thereof, and while the preferred embodiments have been described in considerable detail, it is not intended to restrict or in any way limit the scope of the appended claims to such details. Additional advantages and modifications within the spirit and scope of the present disclosure will readily appear to those skilled in the art. Therefore, the present disclosure is not limited to the specific details and illustrative examples shown and described.

What is claimed is:

1. A light emitting diode (LED) driving circuit which comprises:

a power supply circuit comprising a first energy storage device and a switch component connected to the first energy storage device, the first energy storage device adapted to store electric energy when the switch component is switched on;

an LED circuit connected to the first energy storage device; wherein the LED circuit comprises at least one LED and a resistor connected to the LED in series, the LED comprises a second anode connected to the power supply circuit and a second cathode connected to a node; and a first terminal of the resistor connected to the node, and a second terminal of the resistor connected to ground;

a switch control circuit connected to the switch component; and a voltage comparing circuit, connected to the switch control circuit, adapted to detect whether a voltage of the LED circuit is less or more than a reference voltage; wherein the voltage comparing circuit comprises a comparator, the comparator includes a positive input terminal coupled to a reference voltage, a negative input terminal connected to the node, and a comparator output terminal connected to the switch control circuit; and the switch control circuit comprises a NAND gate and an AND gate, the NAND comprises a first input terminal coupled to a square wave generator, a second input terminal connected to the comparator output terminal, and a first output terminal connected to the AND gate; and the AND gate comprises a third input terminal connected to the first output terminal, a fourth input terminal connected to the comparator output terminal, and a second output terminal connected to the switch component;

wherein the switch control circuit is adapted to control the switch component to be switched on or off periodically when the voltage is not more than the reference voltage, or control the switch component to be switched off when the voltage is more than the reference voltage.

2. The LED driving circuit of claim 1, wherein the power supply circuit further comprises a second energy storage device connected to the LED circuit, and the first energy storage device is adapted to discharge electric power to the second energy storage device when the switch component is in a switch-off state.

3. The LED driving circuit of claim 2, wherein the first energy storage device is an inductor, the second energy storage device is a capacitor, and the switch component is a transistor.

4. The LED driving circuit of claim 3, wherein the transistor is an N-channel enhancement field effect transistor having a gate, a drain, and a source; the inductor comprises a first terminal coupled to a power supply, and a second terminal connected to the drain; the gate is connected to an output terminal of the switch control circuit; and the source is connected to ground; and the capacitor comprises a third terminal connected to the drain, and a fourth terminal connected to ground.

5. The LED driving circuit of claim 4, wherein the power supply circuit further comprises a diode with a first anode and a first cathode, the first anode is connected to the second terminal, and the first cathode is connected to third terminal.

6. A light emitting diode (LED) driving circuit which comprises:

a power supply circuit comprising a first energy storage device, a second energy storage device connected to the first energy storage device, and a switch component connected to the first energy storage device; and the first energy storage device adapted to store electric power when the switch component is switched on, and adapted to discharge electric power to the second energy storage device when the switch component is switched off;

an LED circuit connected to the power supply circuit; wherein the LED circuit comprises a plurality of LEDS and a resistor connected in series, the plurality of LEDs comprises a first LED with a first LED anode connected to the power supply circuit and a first LED cathode connected to a common node; and a first terminal of the resistor is connected to the common node, and a second terminal of the resistor is connected to ground;

a voltage comparing circuit adapted to output a signal that indicates whether a voltage of the LED circuit is less or more than a reference voltage; wherein the voltage comparing circuit comprises a comparator, the comparator includes a positive input terminal coupled to a reference voltage, a negative input terminal connected to the common node, and a comparator output terminal; and a switch control circuit, connected to the switch component; adapted to receive the signal from the voltage comparing circuit and control on/off states of the switch component according to the signal, thereby adjusting a current flowing through the LED circuit; wherein the switch control circuit comprises a NAND gate and an AND gate, the NAND comprises a first input terminal coupled to a square wave generator, a second input terminal connected to the comparator output terminal, and a first output terminal connected to the AND gate; and the AND gate comprises a third input terminal connected to the first output terminal, a fourth input terminal connected to the comparator output terminal, and a second output terminal connected to the switch component.

7. The LED driving circuit of claim 6, wherein the first energy storage device is an inductor, the second energy storage device is a capacitor, and the switch component is a transistor.

8. The LED driving circuit of claim 7, wherein the transistor is an N-channel enhancement field effect transistor having a gate, a drain, and a source; the inductor comprises a first terminal coupled to a power supply, and a second terminal connected to the drain; the gate is connected to an output terminal of the switch control circuit; and the source is connected to ground; and the capacitor comprises a third terminal connected to the drain, and a fourth terminal connected to ground.

9. The LED driving circuit of claim 8, wherein the power supply circuit further comprises a diode with an anode and a cathode, the anode is connected to the second terminal, and the cathode is connected to third terminal.

10. The LED driving circuit of claim 6, wherein the plurality of LEDS further comprises a second LED and a third LED; the second LED comprises a second LED anode connected to the first LED cathode and a second LED cathode;

and the third LED comprises a third LED anode connected to the second LED cathode and a third LED cathode connected to the common node.

* * * * *